US005984462A

United States Patent [19]

DeFilippis

[11] Patent Number: 5,984,462

[45] Date of Patent: Nov. 16, 1999

[54] ONE SHOT AIR PURGE FOR REPLACEABLE INK SUPPLY

[75] Inventor: Michael S. DeFilippis, Corvallis, Oreg.

[73] Assignee: Hewlett-Packard Company, Palo Alto, Calif.

[21] Appl. No.: 09/264,614

[22] Filed: Mar. 8, 1999

Related U.S. Application Data

[63] Continuation of application No. 09/069,718, Apr. 29, 1998.

[51] Int. Cl.[6] ..... B41J 2/175

[52] U.S. Cl. ..... 347/86

[58] Field of Search ..... 347/85, 86, 87, 347/29, 30, 35

[56] References Cited

U.S. PATENT DOCUMENTS

| | | | |
|---|---|---|---|
| 3,092,106 | 6/1963 | Butler | 128/214 |
| 3,974,508 | 8/1976 | Blumenthal | 347/22 |
| 4,148,041 | 4/1979 | Rosenstock | 347/28 |
| 4,494,124 | 1/1985 | Piatt et al. | 347/83 |
| 4,518,974 | 5/1985 | Isayama | 347/92 |
| 4,575,738 | 3/1986 | Sheufelt et al. | 347/94 |
| 4,586,058 | 4/1986 | Yamazaki et al. | 347/92 |
| 4,695,824 | 9/1987 | Tazaki | 347/86 |
| 4,788,556 | 11/1988 | Hoisington et al. | 347/82 |
| 4,870,431 | 9/1989 | Sousa et al. | 347/25 |
| 4,968,998 | 11/1990 | Allen | 347/7 |
| 5,023,629 | 6/1991 | Kiyohara | 347/36 |
| 5,138,332 | 8/1992 | Carlotta | 347/92 |
| 5,185,614 | 2/1993 | Courian et al. | 347/24 |
| 5,394,181 | 2/1995 | Braun | 347/92 |
| 5,477,963 | 12/1995 | Mochizuki et al. | 206/701 |
| 5,485,187 | 1/1996 | Okamura et al. | 347/85 |
| 5,488,401 | 1/1996 | Mochizuki et al. | 347/86 |
| 5,540,569 | 7/1996 | Altham et al. | 417/420 |
| 5,590,510 | 1/1997 | Mochizuki et al. | 53/434 |
| 5,646,666 | 7/1997 | Cowger et al. | 347/87 |
| 5,650,811 | 7/1997 | Seccombe et al. | 347/85 |
| 5,675,367 | 10/1997 | Scheffelin et al. | 347/86 |
| 5,700,315 | 12/1997 | Wenzel | 106/31.58 |
| 5,721,576 | 2/1998 | Barinaga | 347/85 |

*Primary Examiner*—N. Le
*Assistant Examiner*—Michael Nghiem
*Attorney, Agent, or Firm*—Timothy F. Myers; Raymond A. Jenski

[57] ABSTRACT

A one-shot air purge apparatus for an inkjet cartridge for removing air accumulated within the cartridge. The inkjet cartridge comprises a print cartridge base and a replaceable ink receptacle. The replaceable ink receptacle comprises an ink supply coupled to an ink supply seal and a vacuum chamber coupled to an air purge seal. The print cartridge base comprises a printhead, a sub-receptacle coupled to the printhead and an ink supply needle which has an eyelet, an air pocket reserve in which the air accumulates coupled to an air purge needle that has an eyelet. The ink supply needle eyelet is coupled to the ink supply seal before the air purge needle eyelet is coupled to the air purge seal of the vacuum chamber.

14 Claims, 5 Drawing Sheets

ONE SHOT AIR PURGE FOR REPLACEABLE INK SUPPLY

CROSS REFERENCES TO CO-PENDING APPLICATION

This application is a continuation of U.S. patent application No. 09/069,718, filed on Apr. 29, 1998, assigned to the assignee of the present application.

BACKGROUND OF THE INVENTION

The present invention relates to inkjet printing apparatus and is concerned, more particularly, with the purging of air from a permanent inkjet cartridge base after a new ink supply has replaced a previous ink supply.

In a thermal ink jet printer, energy pulses, in a printhead, are used to heat and vaporize ink in an ink channel formed in the printhead. This vaporized ink creates vapor bubbles that grow to fill the channels and expel ink that was in the channel out through a set of orifices on the face of the printhead. The orifices are shaped to direct the ink outward onto a recording medium. Ink then refills the channel inside the printhead, usually by capillary action, which in turn draws ink into the printhead from an ink supply.

It is usually necessary to prime a printhead of an inkjet printer before use, to remove air and ensure that the printhead is full of ink. Priming, for example, may be carried out by applying suction to the ink ejecting orifices to draw ink into the printhead from the ink supply under pressure. Some approaches use a suction cap over the orifices to recover the ink ejection unction of the printhead after a period of non-use. In many such printers, the printhead receives its supply of ink from a sub-receptacle, which in turn receives its supply of ink from a main receptacle. Air collects in the sub-receptacle and is removed by applying suction to the sub-receptacle before suction is supplied to the printhead orifices. The mechanism providing the suction adds additional cost and complexity to the printer.

Some printers reduce complexity by just using a replaceable ink cartridge that incorporates a pressure regulating mechanism within the ink supply. The pressure regulating mechanism inside the ink cartridge increases the size and cost of the cartridge body. The increased size of the cartridge body in turn requires a greater carriage mass and cost, thereby discouraging production of more compact, portable, and low-priced inkjet printers. A significant number of improvements in printheads and pressure regulator mechanisms have occurred over the years. These improvements are now yielding improvement in the useful life of printheads and pressure regulators which exceeds the expected use of the supply of ink. Thus, when the user discards the ink cartridge, the printhead and pressure regulating mechanisms are also discarded, even though they may have a significant period of usable life remaining. Disposal of these parts, which may still be useful, and any remaining ink in the ink supply results in an increased cost to the user and is an inefficient use of resources.

To address problems with disposable ink cartridges, some inkjet printers have permanent, refillable remote ink supplies that are not mounted to the carriage. Such ink supplies, because they are stationary within the printer, are not subject to all of the size constraints of an ink supply that is moved with the carriage. Usually, the printhead will include a small ink reservoir that is periodically replenished by moving the printhead to a refilling station that has a stationary built in reservoir. See, for example, commonly assigned U.S. Pat. No. 4,968,998.

Other printers use replaceable remote reservoirs that are not located on the carriage and do not move with the printhead during printing. Replaceable reservoirs are often plastic bags filled with ink. The bag is provided with a septum that can be punctured by a hollow needle, for coupling ink inside the bag to the printer and which allows ink to flow from the bag to the printhead. The bag may be squeezed or pressurized in some other manner to cause ink to flow from the reservoir.

An example of an inkjet printing system using ink reservoirs is disclosed in U.S. Pat. No. 5,650,811. In this system, ink is drawn from a stationary reservoir and pressurized to propel the ink through a supply tube to a first ink containment receptacle in an ink jet cartridge mounted on a movable printer cartridge. A regulator mechanism within the cartridge body intermittently opens to supply ink to a second ink containment receptacle in the cartridge that couples with the printhead orifices through a sub-receptacle which contains an ink filter. The regulator maintains a sufficient backpressure on the ink to prevent it from drooling out of the printhead.

All of these different printer systems are plagued by unwanted air that enters the ink reservoir, supply lines and cartridge in a variety of ways. Air is primarily introduced into the system by evolving as gas when ink is heated at the printhead. Other sources of air ingestion are from empty supply lines before printer initialization, by "air gulping" through fluid interconnects during start up or operation and by diffusion through the walls of system components (such as cartridge body walls or tubes). Air in the ink supply system can cause "dry firing" of the drop generator (usually a resistor or piezo electric actuator), which damages the printhead. Alternatively, gas bubbles in supply lines can interfere with hydraulic flow through supply lines or capillary movement of ink through the small orifices at the printhead.

Printer vendors have tried many different approaches to eliminate unwanted gas in the ink supply flow path. Some inkjet cartridges (such as the cartridges used in the HP 2000C inkjet printer available from Hewlett-Packard Co.) are designed with empty internal space to "warehouse" air over the life of the cartridge. The additional space required for warehousing air in the moveable cartridge increases the size of the printer to accommodate the bulky cartridge over its path of movement. Another vendor's printer uses an air separator between an ink reservoir and cartridge body to remove air from the ink supply flow path, but this solution requires complex additional components that increase the size and cost of the printer.

Therefore, a new ink supply system is needed that can be replaceable, yet allow for the use of a permanent printhead, and which allows for production of low cost and non-complex printers than existing designs.

SUMMARY OF THE DISCLOSURE

A one-shot air purge apparatus for an inkjet cartridge for removing air accumulated within the cartridge. The inkjet cartridge comprises a print cartridge base and a replaceable ink receptacle. The replaceable ink receptacle comprises an ink supply coupled to an ink supply seal and a vacuum chamber coupled to an air purge seal. The print cartridge base comprises a printhead, a sub-receptacle coupled to the printhead and an ink supply needle which has an eyelet, an air pocket reserve in which the air accumulates coupled to an air purge needle that has an eyelet. The ink supply needle eyelet is coupled to the ink supply seal before the air purge needle eyelet is coupled to the air purge seal of the vacuum chamber.

DETAILED DESCRIPTION OF THE PREFERRED EMBODIMENTS

The present invention solves the problem of air accumulation, which plagues other implementations of replaceable ink receptacle cartridge designs. The unique features of the invention is the method with which the system is purged of accumulated gases (air) and by which the purge mechanism is completely contained within a replaceable receptacle supply. This results in less cost and complexity to the printer, and in most embodiments, no special action is required by the end-user. An air purging action occurs every time a user inserts a new replaceable ink supply into a printhead cartridge base. This air purge mechanism is essentially a small low air pressure chamber, which is sealed by a seal comprising a septum and a crimp cap. Those skilled in the art will appreciate that other seal mechanisms are possible and still fall within the spirit and scope of the invention. In one embodiment, when the replaceable ink supply, containing both the air purge mechanism and the ink reservoir, is inserted into a cartridge, the ink supply needle of the cartridge breaks the septum seal on the ink reservoir in the ink supply. At the same time or slightly after, the septum seal on the air purge mechanism is broken by the air purge needle of the cartridge. As the low pressure in the purge mechanism equalizes with the pressure of the ink in the cartridge, an ink flow is created from the cartridge body into the purge mechanism. If gases have accumulated within the cartridge base in a sub-receptacle and into a reserve formed into the sub-receptacle and coupled to the air purge needle, these gases will move into the air purge mechanism. If there are no gases present and only ink, then ink will flow into the purge mechanism. The volume of ink or gas, which becomes trapped in the purge mechanism, is replaced by ink from the ink reservoir. Once the purge mechanism has fully expanded or equalized, it remains expanded or equalized for the remainder of the replaceable supply's operational life. When the user eventually replaces the ink supply with a new one, this cycle is repeated. So long as the purge mechanism is sized such that it removes as much or slightly more gas volume than is created by the volume of ink in one replaceable ink supply, the print cartridge base's sub-receptacle reserve will never accumulate more than the gas volume associated with the printing of one supply of ink.

Figure 1A:
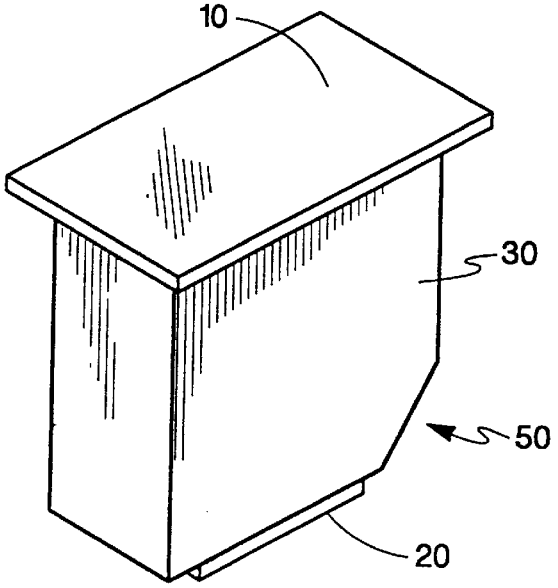
FIG. 1A is an isometric view of an inkjet print cartridge.

FIG. 1A is an isometric view of a print cartridge showing replaceable ink receptacle 10, which is inserted in print cartridge base 30. Together, they comprise ink jet cartridge 50. Attached to print cartridge base 30 is printhead 20.

Figure 1B:
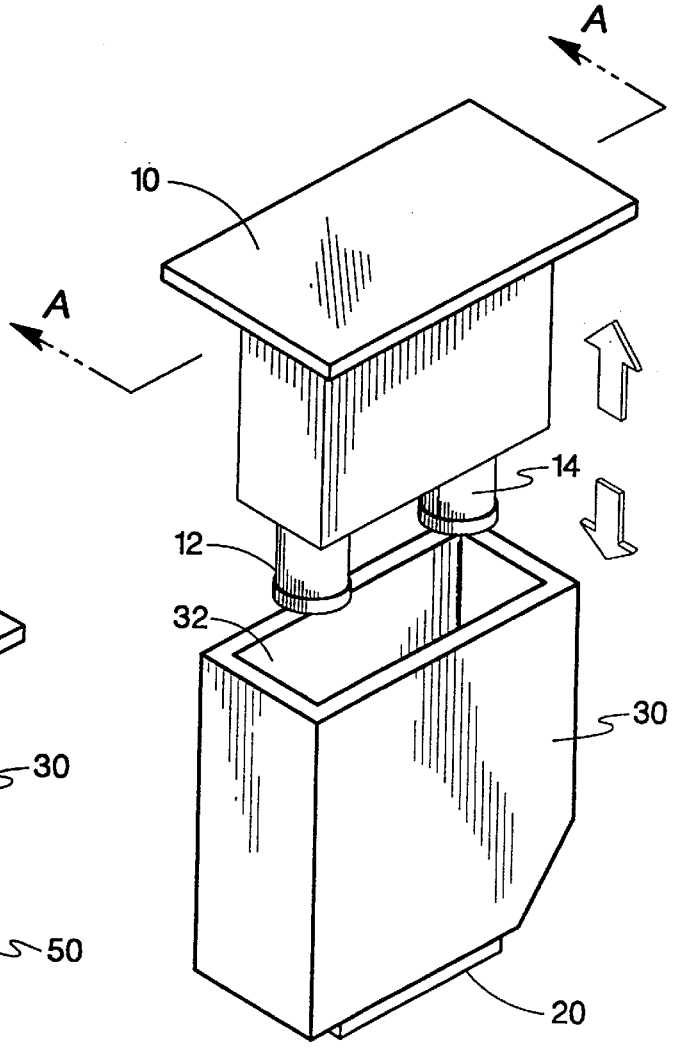
FIG. 1B is an isometric view of the print cartridge in FIG. 1A illustrating a replaceable ink receptacle and its removal or insertion into a print cartridge base.

FIG. 1B is an isometric drawing illustrating the assembly and disassembly of replaceable ink receptacle 10 into and out of print cartridge base 30. Attached to replaceable ink receptacle 10 is an ink well septum 12 and an air purge septum 14. Ink well septum 12 provides a conduit for the ink stored in the replaceable ink receptacle 10 to the printhead 20. Air purge septum 14 provides a conduit to remove air and ink from the sub-receptacle 66 (FIG. 2) to prevent the printhead from failing due to air ingestion. The replaceable ink receptacle 10 is inserted into cavity 32. The cavity 32 guides, using either rails or grooves (neither shown) molded in the cartridge base, the replaceable ink receptacle 10 such that the ink well septum 12 establishes its ink conduit before air purge septum 14 establishes its conduit for removing air and ink from the sub-receptacle 66.

Several methods exist for establishing the ink well septum's 12 conduit path before establishing the air purge septum's 14 conduit path. On method, assuming ink well septum 12 and air purge septum 14 are coplanar, is to have a hollow needle, or cannula, which pierces ink well septum 12 be at a taller height than a hollow needle that air purge septum 14 interfaces with. Another approach is to have the ink well septum 12 be a longer length than air purge septum 14 and the respective interface needles would be coplanar in the print cartridge base. A different approach is to have the ink well septum 14, and air purge septum 16 be the same length, thus their interfaces being coplanar, and to also have the respective interface needle in the print cartridge base be coplanar. Each needle is hollow and has as an eyelet opening into the hollow portion of the needle. On the ink well septum 14, this ink supply eyelet 42 is near the tip of the needle that punctures the ink well septum 14. The eyelet on the air purge needle is lower from the tip, which punctures the air purge septum 16. This spacing of the needle eyelets allows the ink supply to be connected to the printhead before applying the vacuum to the sub-receptacle 66 to remove the air pocket reserve 34 and ink.

Figure 2:
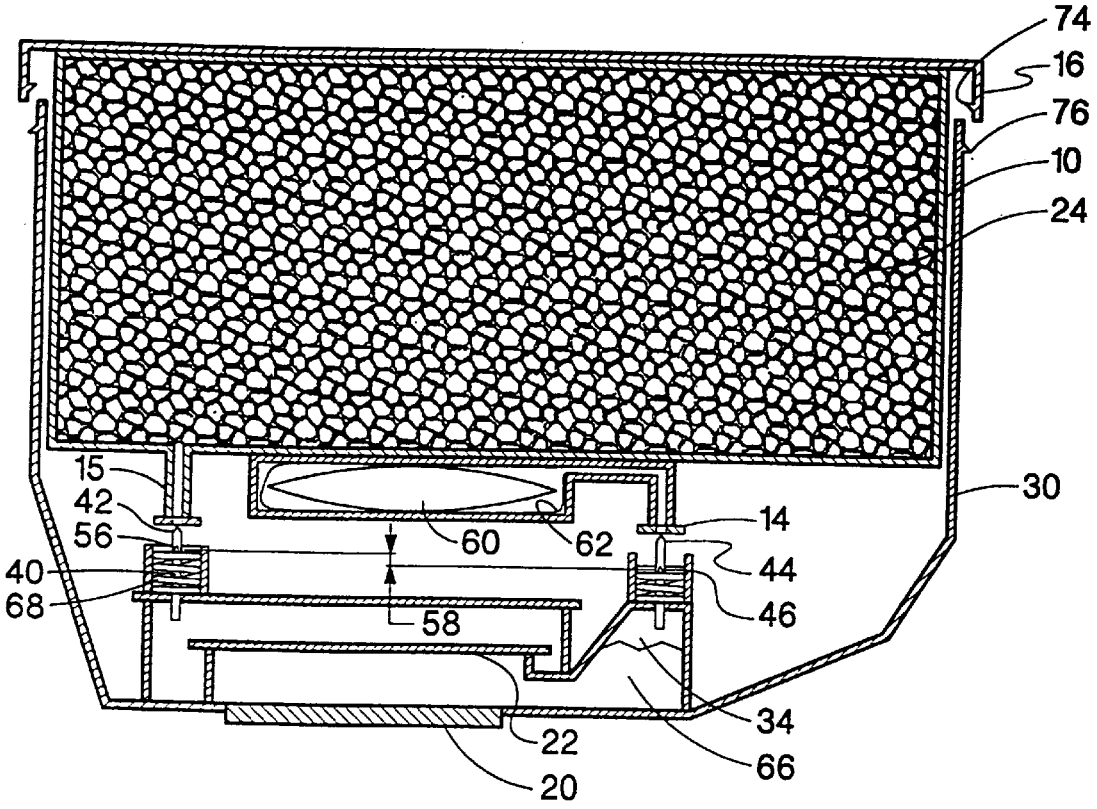
FIG. 2 is a cross-sectional view along the AA perspective of FIG. 1B illustrating a first embodiment of the invention, which uses a spring bag vacuum chamber.
Figure 3:
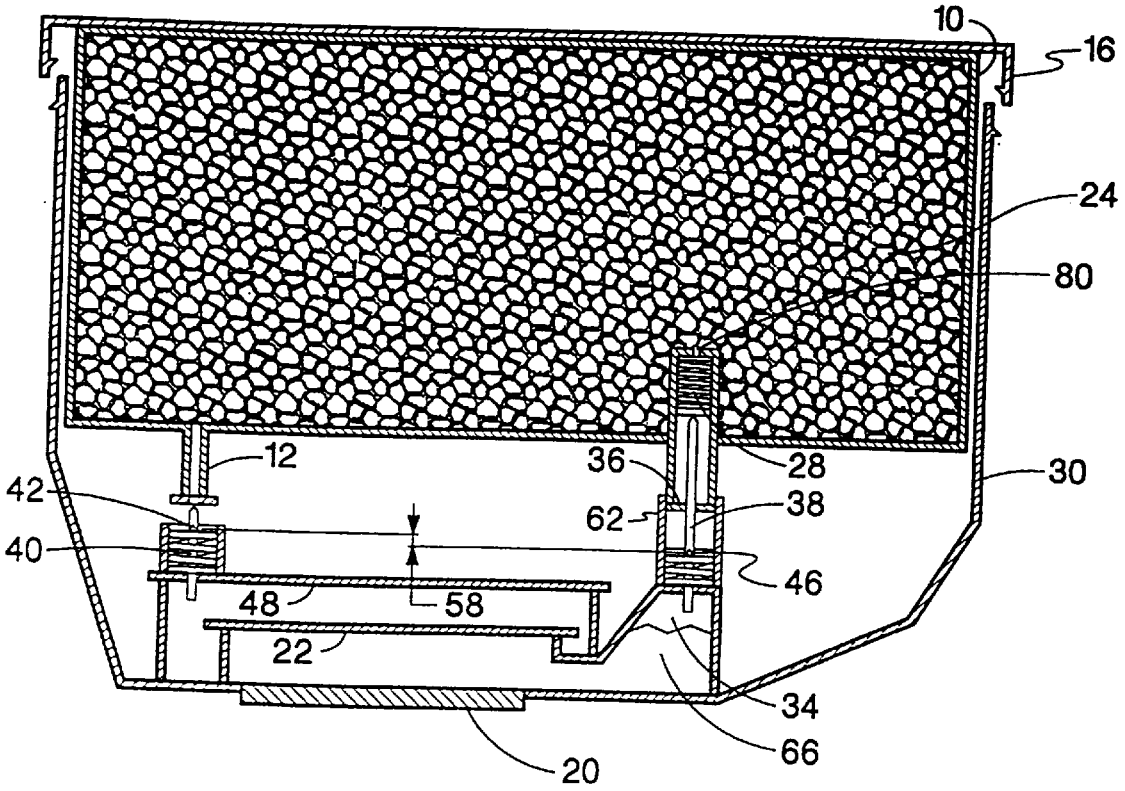
FIG. 3 is a cross-sectional view along the AA perspective of FIG. 1B illustrating a second embodiment of the invention which creates a vacuum during insertion of the replaceable ink receptacle into the print cartridge base.
Figure 4:
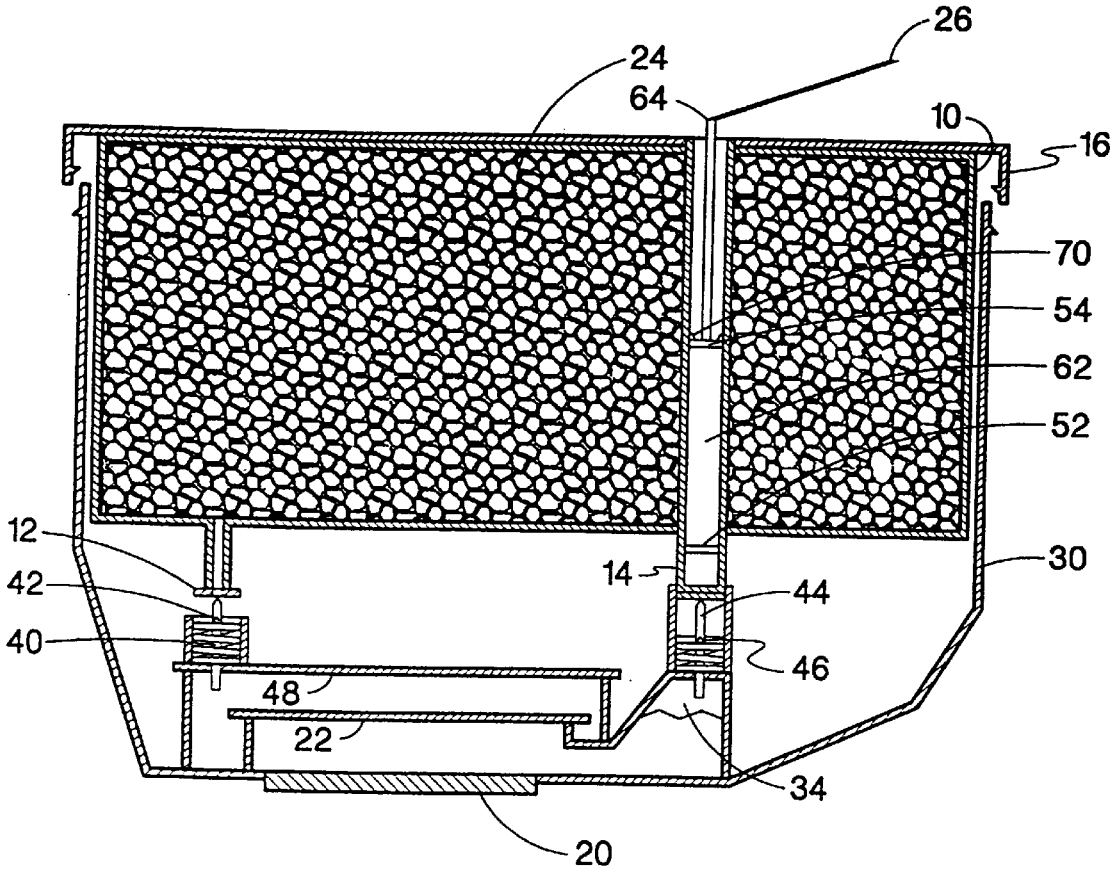
FIG. 4 is a cross-sectional view along the AA perspective of FIG. 1B illustrating a third embodiment of the invention, which creates a vacuum by user intervention.
Figure 5:
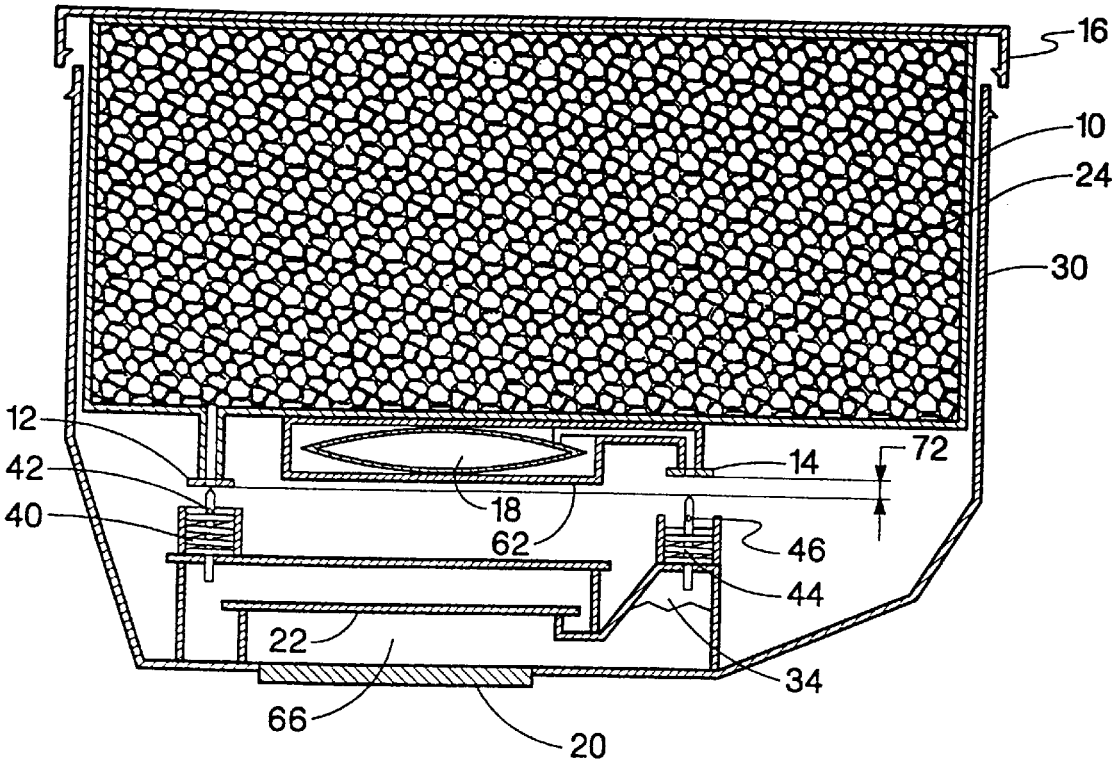
FIG. 5 is a cross-sectional view along the AA perspective of FIG. 1B illustrating a fourth embodiment of the invention, which uses a preformed bulb vacuum chamber.

Several embodiments are illustrated in FIGS. 2–5. FIG. 2 illustrates a first alternative embodiment of the invention, FIG. 3 is a second alternative embodiment, FIG. 4 is a third alternative embodiment, and FIG. 5 is a fourth alternative embodiment.

FIG. 2 is a cross-sectional drawing of FIG. 1B taken along the AA perspective. Shown is a replacement ink receptacle 10, further comprising receptacle lip 16 having lip snaps 74, as replaceable ink receptacle 10 is about to come in contact with ink supply needle 40 and air purge needle 44 in a print cartridge base 30 which has base snaps 76. The ink supply needle 40 has an ink supply eyelet 42 that is near the tip of the ink supply needle 40. Air purge needle 44 has an air purge eyelet 46. The difference in height (from coplanarity) is illustrated by eyelet differential 58.

Also shown is a sliding seal 56 on both the ink supply needle 40 and air purge needle 44. This sliding seal 56 (see commonly assigned U.S. Pat. No. 5,721,576) is supported by seal spring 68. The purpose of the sliding seal is to prevent leakage of ink or air after the respective needle punctures a septum and when the print cartridge base 30 is disconnected from the replaceable ink receptacle 10. The seal spring 68 provides pressure on the sliding seal 56 to maintain the seal.

The vacuum supplied by vacuum chamber 62 in replaceable ink receptacle 10 is shown as a spring-loaded bag 60, see, for example, commonly assigned U.S. Pat. No. 5,675, 367. Air is withdrawn from the spring-loaded air bag 60 and sealed with air purge septum 14 to maintain the vacuum. When the air purge septum 14 is pierced by air purge needle 44 and when air purge eyelet 46 is exposed within the air purge septum 14, the springs within the spring loaded air bag 60 expand the bag, thus drawing in air pocket reserve 34 and ink, as necessary to balance out the air pressure, from sub-receptacle 66. A vacuum chamber 62, containing the spring-loaded air bag 60, is shown as an appendage on replaceable ink receptacle 10. This approach allows the replaceable ink receptacle 10 to be refilled and vacuum chamber 62 to be replaced or refurbished without the need to replace the printhead and pressure regulating mechanism.

In FIG. 2, ink enters sub-receptacle 66 through ink supply needle 40, which is hollow and which has an ink supply eyelet 42 that allows ink to enter the needle. Before the ink reaches printhead 20, it must go through ink filter 22 which prevents large particles from entering printhead 20 thereby preventing fouling or plugging of the printhead orifices. (See commonly assigned U.S. Pat. Nos. 5,675,367 and 5,700,315).

FIG. 3 illustrates a second embodiment of the invention. This embodiment has an advantage in that the vacuum used to draw the air pocket reserve 34 out of the sub-receptacle 66 is not created until the replaceable ink receptacle 10 is inserted into the cavity 32 (FIG. 1B) of the print cartridge base 30. In this embodiment, the air purge needle 38 is longer than ink supply needle 40. When the replaceable ink cartridge 10 is inserted into print cartridge base 30, a plunger 36 is moved inside of vacuum chamber 62 much like a surgical syringe thereby creating a vacuum. Air or ink on the other side of the plunger 36 is forced into ink supply 24 through vent 80. Optionally, plunger spring 28 can be used to help stabilize plunger 36 to maintain its seal as it traverses within vacuum chamber 62. When air purge eyelet 46 enters the vacuum chamber 62, the vacuum created inside the vacuum chamber 62 draws the air pocket reserve 34 and ink into the vacuum chamber 62. As in FIG. 2, the air purge eyelet 46 is at a lower position than ink supply eyelet 42 represented by eyelet differential 58.

FIG. 4 illustrates a third embodiment in which vacuum chamber 62 extends through the replaceable ink receptacle 10. In this embodiment, the vacuum within the vacuum chamber 62 is formed by the user pulling on plunger pull 26 until the plunger 54 moves from initial plunger position 52 and encounters plunger stops 70. Plunger pull 26 has a break point 64 so that the plunger pull 26 can be removed after the air purge has occurred. This approach has the disadvantage of requiring user intervention, but it provides a method by which a larger volume of air or ink can be removed, especially for larger replaceable ink receptacles.

Alternatively, the user may evacuate the vacuum chamber 62 before inserting the replaceable ink receptacle 10. Another embodiment of the vacuum chamber 62 would be to have vacuum chamber 62 sealed and comprising a volume that is evacuated of air. When the air purge septum 14 is pierced and the air purge eyelet 46 exposed, the air pressure inside the vacuum chamber 62 will equalize with the back pressure provided by the ink delivery system, thereby drawing up the air pocket reserve 34 from the sub-receptacle 66. The volume required to be evacuated in vacuum chamber 62 in this embodiment can be determined by the following formula:

$$P_l V_l = P_b (V_l - V_p)$$

where $P_l$=pressure inside the air purge mechanism before purging, $P_b$=pressure inside the cartridge to be purged, $V_l$=volume in the purge space, and $V_p$=Volume of air to be purged.

Using the above formula and because the pressure within a new print cartridge is known, a tradeoff can be made in the volume of the air purge mechanism versus the amount of pressure desired in the air purge mechanism and the volume of air or ink to be withdrawn from the cartridge base sub-receptacle. By way of example, let the pressure within the air purge mechanism ($P_l$) be 50 kPascals, let the pressure inside the cartridge ($P_b$) be 100 kPascals, and let the volume of air to be purged ($V_p$) be 0.5 cc. Then solving for $V_l$, the volume of the air purge mechanism, $$V_1 = \frac{P_b V_p}{P_b - P_1} = \frac{100 \text{ kPa } (0.5) \text{ cc}}{100 \text{ kPa} - 50 \text{ kPa}} = 1 \text{ cc.}$$

If the seal mechanism on the air purge mechanism can withstand a greater vacuum, the volume of the air purge mechanism $V_l$ can be made smaller.

FIG. 5 illustrates a fourth embodiment that is similar to that shown in FIG. 2. The spring-loaded air bag of FIG. 2 has been replaced with a molded rubber or plastic bulb which has a natural shape to which the bulb returns to after the vacuum seal has been broken. In addition, this embodiment demonstrates how air purge septum 14 can be shorter than ink supply septum 12 as illustrated by septum differential 72. In this embodiment, air purge eyelet 46 and ink supply eyelet 42 are at the same height. Therefore, the ink supply will make fluidic conduit before the vacuum chamber makes the air purge conduit, thus extracting the air pocket reserve 34 after the ink flows into sub-receptacle 66 from the ink supply needle 40. As in FIG. 2, the vacuum chamber 62 is shown as an attachment to replaceable ink receptacle 10 in order to allow for refurbishment.

All of the embodiments have shown ink supply 24 as a foam based regulator ink delivery system. Those skilled in the art will appreciate that other regulators used to control the back pressure of ink in an ink receptacle are known exist and could be used, such as spring loaded bags or bubblers, and still fall within the spirit and scope of the invention.

What is claimed is:

1. A replaceable ink receptacle for a print cartridge having a set of hollow needles, comprising:

an ink supply;

an ink supply seal fluidically coupled to said ink supply;

a vacuum chamber adjacent to said ink supply; and an air purge seal fluidically coupled to said vacuum chamber;

wherein said ink receptacle is capable of being coupled to the set of hollow needles in the print cartridge through the ink supply seal and the air purge seal respectively.

2. The replaceable ink receptacle of claim 1 wherein the set of hollow needles are comprised of an ink supply needle and an air purge needle, the replaceable ink receptacle further comprising means for coupling said replaceable ink receptacle to said print cartridge comprising coupling said ink supply needle to said ink supply seal before coupling said air purge needle to said air purge seal.

3. The replaceable ink receptacle of claim 2, wherein said means for coupling further comprises having said ink supply seal having a first length and said air purge seal having a second length and wherein said first length is different than said second length.

4. The replaceable ink receptacle of claim 2, wherein said vacuum chamber further comprises:

a plunger; and wherein said air purge needle has an eyelet a first length from said ink supply, said ink supply needle has an eyelet a second length from said ink supply, said first length to said eyelet of said air purge needle being longer than said second length to said eyelet of said ink supply needle and wherein said air purge needle contacts said plunger, displacing said plunger to form a vacuum during coupling of said replaceable ink receptacle to said print cartridge.

5. The replaceable ink receptacle of claim 1, wherein said vacuum chamber further comprises an evacuated formed container having a predetermined shape and volume before being evacuated and a new shape and volume after being evacuated, said evacuated formed container fluidically coupled to said air purge seal, said evacuated formed container returns to said predetermined shape and volume when said air purge seal is broken by said air purge needle.

6. The replaceable ink receptacle of claim 1, wherein said vacuum chamber is capable of being removed and replaced from said replaceable ink receptacle.

7. The replaceable ink receptacle of claim 1, wherein said vacuum chamber further comprises:

a set of walls;

a plunger pull, having a first end and a second end, said plunger pull first end extending out of said vacuum chamber;

a plunger having a first position and a second position, said plunger attached to said plunger pull second end; and at least one plunger stop attached to said set of walls;

wherein a vacuum is formed in said vacuum chamber when said plunger is moved from said first position to said second position by a force exerted on said plunger pull, said second position being determined by said at least one plunger stop.

8. The replaceable ink receptacle of claim 1, wherein said vacuum chamber further comprises:

a set of walls; and a volume of space, defined by said set of walls and evacuated of air thereby forming a vacuum, wherein said volume of space is sealed with said air purge seal.

9. A replaceable ink receptacle capable of being accepted by a print cartridge for an inkjet printer, the print cartridge having a first cannula having an eyelet and a second cannula having an eyelet, the replaceable ink receptacle comprising:

an ink supply; and a vacuum chamber;

wherein the first cannula and the second cannula are spaced apart and arranged so that when said replaceable ink receptacle is accepted into said print cartridge said eyelet of said first cannula couples into said ink supply before said eyelet of said second cannula couples into said vacuum chamber.

10. A print cartridge adapted for accepting a replaceable ink receptacle having a set of seals, comprising:

a printhead;

a sub-receptacle fluidically coupled to said printhead;

a hollow ink supply needle having an eyelet, said hollow ink supply needle being fluidically coupled to said sub-receptacle through said eyelet of said hollow ink supply needle;

an air pocket reserve within said sub-receptacle wherein excess air collects; and a hollow air purge needle having an eyelet, said hollow air purge needle being fluidically coupled to said air pocket reserve through said eyelet of said hollow air purge needle;

wherein said print cartridge is capable of being coupled to the set of seals in the replaceable ink receptacle.

11. The print cartridge of claim 10, wherein said set of seals are comprised of an ink supply seal and an air purge seal, the print cartridge further comprising means for coupling said print cartridge to the replaceable ink receptacle, said means for coupling comprising coupling said ink supply needle to said ink supply seal before coupling said air purge needle to said air purge seal.

12. The print cartridge of claim 11, wherein said means for coupling further comprises having said eyelet of said air purge needle at a lower height than said eyelet of said ink supply needle.

13. The print cartridge of claim 12, wherein said means for coupling further comprises having said air purge needle having a first length and said ink supply needle having a second length, and wherein said first length is not equal to said second length.

14. A print cartridge for an inkjet printer, the print cartridge capable of accepting a replaceable ink receptacle having an ink supply and a vacuum chamber, the print cartridge comprising:

a sub-receptacle which collects air in an air pocket reserve;

a printhead;

a first cannula having an eyelet, said first cannula coupling the ink supply to said printhead; and a second cannula having an eyelet, said second cannula coupling the vacuum chamber to said sub-receptacle;

wherein said eyelet of said first cannula and said eyelet of said second cannula are spaced apart and arranged so that when the replaceable ink receptacle is accepted into said print cartridge said eyelet of said first cannula couples into the ink supply before said eyelet of said second cannula couples the vacuum chamber to said sub-receptacle.

* * * * *